US005664689A

United States Patent [19]

Mirlisena, Sr.

[11] Patent Number: 5,664,689

[45] Date of Patent: Sep. 9, 1997

[54] SHELF ORGANIZER

[76] Inventor: John Raymond Mirlisena, Sr., 4615 Glenway Ave., Cincinnati, Ohio 45238

[21] Appl. No.: 433,894

[22] Filed: May 2, 1995

[51] Int. Cl.[6] ..... A47F 5/08

[52] U.S. Cl. ..... 211/88.01; 211/74; 211/71.01; 108/69

[58] Field of Search ..... 211/88, 90, 75, 211/71, 74, 175, 113, 153; 108/69, 61

[56] References Cited

U.S. PATENT DOCUMENTS

| | | | |
|---|---|---|---|
| 822,901 | 6/1906 | McKee | 108/69 |
| 2,016,097 | 10/1935 | Parsons . | |
| 3,494,307 | 2/1970 | Kagan | 108/69 |
| 3,514,064 | 5/1970 | Katz | 211/88 X |
| 3,731,819 | 5/1973 | Sandhage . | |
| 4,019,638 | 4/1977 | Miller . | |
| 4,155,312 | 5/1979 | Thorkildson | 211/153 X |
| 4,228,905 | 10/1980 | Cammarota . | |
| 4,700,849 | 10/1987 | Wagner | 211/71 |
| 4,815,393 | 3/1989 | Pollack | 108/69 |
| 4,998,629 | 3/1991 | Cheng | 211/71 |
| 5,025,936 | 6/1991 | Lamoureaux . | |
| 5,524,980 | 6/1996 | Carter et al. | 312/351 |

FOREIGN PATENT DOCUMENTS

| | | | |
|---|---|---|---|
| 1216380 | 4/1960 | France . | |
| 1467849 | 12/1966 | France | 211/74 |

*Primary Examiner*—Brian K. Green
*Assistant Examiner*—Bruce A. Lev
*Attorney, Agent, or Firm*—Wood, Herron & Evans, L.L.P.

[57] ABSTRACT

A shelf organizer includes a generally planar shelf with sleeves affixed to an underside of the shelf. The sleeves are configured for selected items to be inserted therein for storage while other items are placed atop the shelf for storage as is well known. The shelf organizer is used within a cabinet such as a medicine cabinet, or in conjunction with any standard shelf and in one embodiment includes a shelf extension to accommodate differently sized cabinets.

6 Claims, 1 Drawing Sheet

SHELF ORGANIZER

FIELD OF THE INVENTION

This invention relates to storage shelves, and more particularly, to a shelf organizer adapted to be used within a storage cabinet or on a shelf.

BACKGROUND OF THE INVENTION

Storage cabinets have long been known. Generally, such cabinets have a number of horizontal shelves supported at various heights within a housing. The overall size of the cabinet, the width and depth of its shelves, the number of shelves, and the various heights at which the shelves are mounted, are all selected with a view toward the intended use of the cabinet and the maximum use of available space. Thus, medicine cabinets generally have a small overall size, and the shelf width and depth, and vertical distances between shelves, tend to be small because the items stored in medicine cabinets, such as pill bottles, tubes of medicine, toiletries, and the like, tend to be small. On the other hand, the various dimensions of a cabinet intended to be used as a kitchen pantry tend to be larger to accommodate larger items such as food cans, bottles, boxes, and the like.

Regardless of size, however, all such storage cabinets suffer from a similar disadvantage, arising from the fact that the items stored therein are typically of various sizes, and particularly of various heights. As a result, if the vertical distance between two adjacent shelves is selected to accommodate the tallest items on the lower of the two shelves, the space above shorter items on the shelf is wasted. Although shorter items may be stacked one upon another to use some of that wasted space, unless those items are specially made to be stackable, such stacking is often precarious and potentially dangerous, leading to easily knocked-over columns of items. Furthermore, some of the shorter items may be taller than half of the vertical space available, making stacking impossible. In addition, some items may be unstackable because of their shape, such as tubes of medicine, toothpaste tubes, and the like.

A further disadvantage shared by many existing types of cabinets is that the smallest items stored therein tend to get lost among the larger items, making it more difficult to locate them when they are needed. Small, lightweight items also are easily knocked over or inadvertently moved around even if they are not stacked one upon another, which leads to cluttered shelves.

Prior solutions to the problem of cluttered shelves and easily displaced items on a shelf are shown in U.S. Pat. Nos. 2,016,097 and 3,731,819. Each of these patents disclose a rack or shelf which has a plurality of circular sleeves affixed to an upper surface thereof with the major axis of each sleeve being generally vertical. Bottles, cups or other items are placed in the sleeves and supported on the shelf to inhibit the item from being displaced or knocked off the shelf. While the devices disclosed in U.S. Pat. Nos. 2,016,097 and 3,731,819 provide for an organized shelf, the storage space on the shelf is inefficiently utilized and only items which are configured to fit within the sleeves can be stored on the shelf.

It has therefore been an object of this invention to provide an improved shelf and/or cabinet design which reduces wasted space and thereby increases the potential capacity of the cabinet and/or shelf.

Another object of the invention has been to provide a device for storing items in a cabinet so that they may readily be found when needed.

A further object of the invention has been to provide such a device which prevents items in a cabinet from being knocked over or inadvertently moved around and thereby reduces clutter in the cabinet and/or on the shelf.

SUMMARY OF THE INVENTION

These and other objectives of the invention are achieved by a shelf organizer according to a presently preferred embodiment of this invention. The shelf organizer comprises one or more sleeves affixed to the underside of one or more shelves of the cabinet. Each sleeve has an open end directed so as to permit bottles, tubes, and other such items to be inserted in the sleeve and stored therein a generally horizontal position. Thus, a long, slender item that is usually placed upright on top of a shelf, such as a bottle, is inserted horizontally into the sleeve, thereby taking up less vertical space atop the shelf. Furthermore, the item is held securely so that it does not get knocked over or inadvertently moved around, and is therefore easy to find when needed.

The number of sleeves affixed to the underside of the shelf is selected according to the intended application. Likewise, the cross-sectional shape and size of a sleeve is selected according to the types of items to be inserted. For example, sleeves with circular cross-sections are desirable in a medicine cabinet to provide for storage of pill bottles and the like. Such circular sleeves may all have the same diameter, or they may have different diameters to accommodate variously sized bottles or other circular items.

In other applications, sleeves with rectangular or square cross-sections are more appropriate for storage of boxes or other noncircular items. Such quadrangular sleeves have the advantage that little space is wasted between the adjacent sleeves and adjacent shelves.

In still other applications, sleeves with other noncircular cross-sections, including but not limited to oval, elliptical, or polygonal shapes, may be employed according to this invention. Further, the use of sleeves of different cross-sectional configurations on the same shelf for particular applications.

A cabinet according to a presently preferred embodiment of this invention generally has an outer enclosure or housing within which are supported a number of generally planar shelves. One or more of the shelves has a sleeve or sleeves affixed to its underside. The cross-sectional size and shape of each sleeve are selected according to the type of item to be inserted.

Another advantageous feature of a presently preferred embodiment of the shelf organizer is its ability to adjust to various size housings or cabinets. Standard medicine cabinets for residential use are typically about 13.25 inches wide; however, some cabinets are wider and measure 13.5 inches in width or larger. The shelf of this invention preferably is adjustable in length to accommodate various width cabinets with a single shelf design. An shelf extension telescopingly extends and retracts relative to the shelf to provide for adjustments as required.

BRIEF DESCRIPTION OF THE DRAWINGS

The objects and features of the invention will become more readily apparent from the following detailed description taken in conjunction with the accompanying drawings in which.

DETAILED DESCRIPTION

Figure 1:
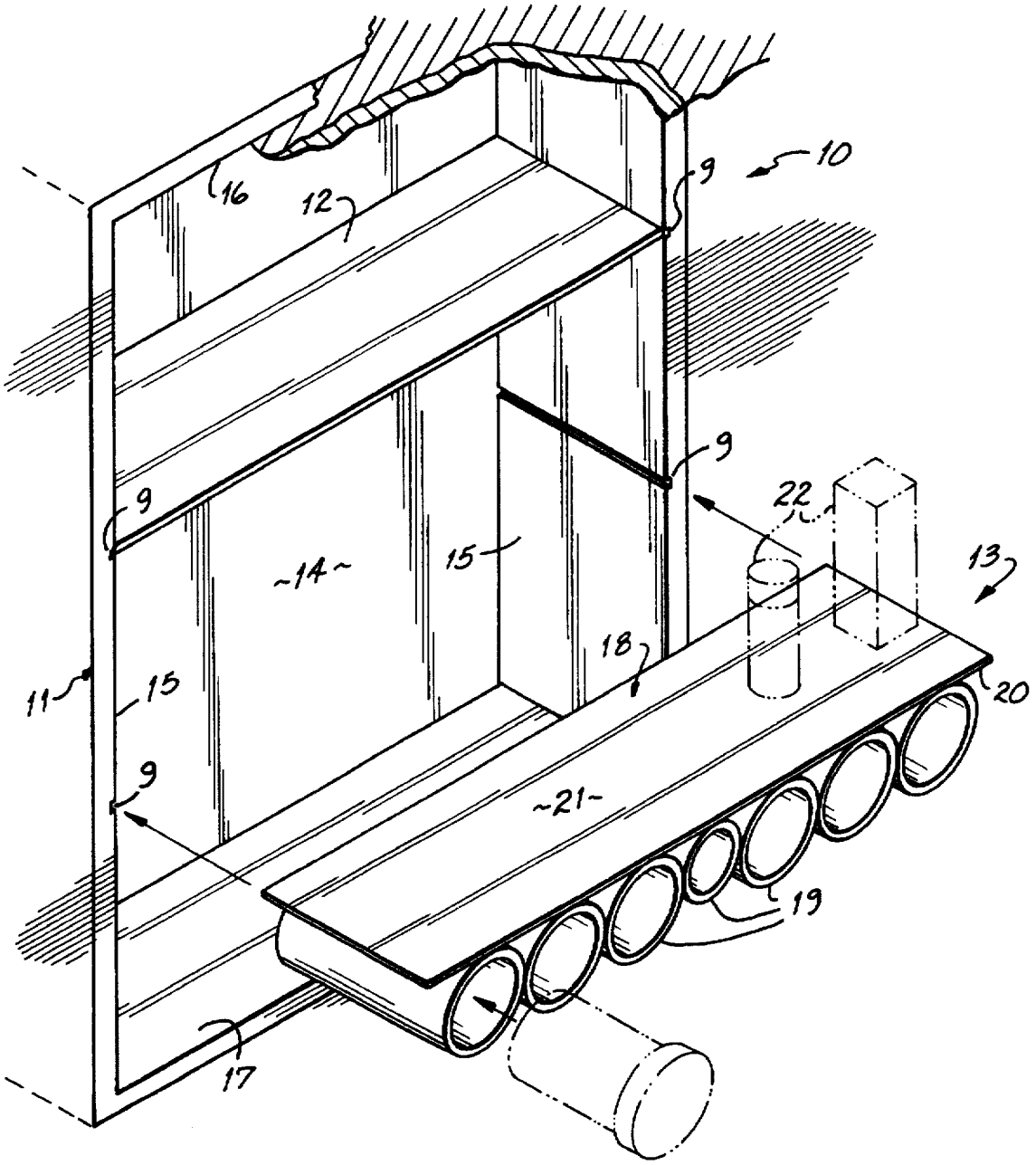
FIG. 1 is a perspective view of a cabinet incorporating a shelf organizer according to this invention.

Referring to FIG. 1, a cabinet 10 comprises a housing 11 within which is supported a shelf 12 and a shelf organizer 13. The housing 11 is formed by securing a back panel 14 to a pair of side panels 15, a top panel 16, and a bottom panel 17. The shelf 12 and shelf organizer 13 are supported in the cabinet 10 by slots 9 in the side panels 15. The top panel 16 is additionally secured to the upper ends of the side panels 15, and the bottom panel 17 is additionally secured to the lower ends of the side panels 15. It will be understood that cabinets of other configurations and construction can be used with the shelf organizer of this invention. Shelf organizer 13 comprises a generally planar and rectangular shelf 18 having a plurality of circular sleeves 19 affixed to an underside 20 of the shelf 18 in a presently preferred embodiment. Shelf 18 has an upper surface 21 on which items 22 may be supported.

Figure 2:
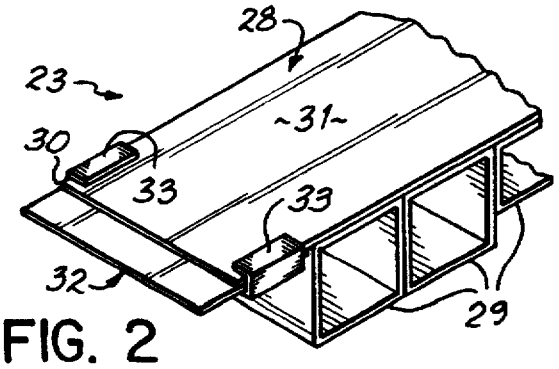
FIG. 2 is a fragmentary perspective view of an alternative embodiment of the shelf organizer according to this invention including a telescoping shelf extension.

Referring to FIG. 2, an alternate embodiment of a shelf organizer 23 is shown. The shelf organizer 23 comprises a shelf 28 having a plurality of quadrangular sleeves 29 affixed to an underside 30 thereof. Shelf 28 has an upper surface 31 on which items may be supported.

As shown in FIG. 1, shelf organizer 13 preferably has a plurality of circular sleeves 19 not all having the same diameter. Shelf organizer 23 preferably has a plurality of quadrangular sleeves 29 not all having the same cross-sectional size and shape as shown in FIG. 2.

The cabinet 10 typically has a door or doors (not shown) on the front thereof. Typically, the housing 11 is arranged with the side panels 15 parallel to each other, and the top and bottom panels 16, 17 parallel to each other and perpendicular to the side panels 15. The housing 11 typically has the back panel 14 secured to the side, top, and bottom panels 15, 16 and 17 such that the back panel 14 is orthogonal to the side, top, and bottom panels 15, 16 and 17.

Various means of securing the panels to each other may be used. The panels may be separate pieces that are secured to one another using well-known techniques, such as fasteners, adhesives, welding, brazing, or soldering. Alternatively, the panels may be secured to one another by being made integral, such as by molding, casting, bending, stamping, or other well-known techniques. A combination of joined and integral panels may also be used.

The side panels 15 of the cabinet 10 are commonly spaced 13.25 inches apart; therefore, the shelf 28 or 18 is preferably about 13.25 inches in length to fit between the side panels 15 of the cabinet in one embodiment. However, residential and commercial cabinets 10 are made in a variety of other sizes and may have the side panels 15 spaced 13.5 inches or more apart. As shown in FIG. 2, the shelf organizer 23 of a presently preferred embodiment includes a shelf extension 32 on one end of the shelf 28. It will be appreciated that although the shelf extension 32 is shown and described with reference to one end of the shelf 28, it can be readily adapted for both ends or another edge or dimension of the shelf organizer 23. The shelf extension 32 is mounted to the shelf 28 by brackets 33 which enable the extensions 32 to telescope into and away from the shelf 28 as required to fit within the cabinet 10 and provide the greatest amount of possible shelf space.

The shelves 12, 28 may be supported within the housing in various ways. They may be supported by means attached to or incorporated within the side panels 15, such as the slots 9. Alternatively, the shelves 12, 28 may be supported on tabs, pins, or brackets that are affixed to the side panels 15 or other known means.

The shelves 12, 28 and cabinet housing 11 may be constructed of a variety of materials, including but not limited to metal, wood, pressed particle board, glass, plastic (including vinyl plastic), or ceramic. Likewise, the sleeves 19, 29 may be made of a variety of materials, including but not limited to wood, metal, plastic (including vinyl plastic), glass or ceramic.

The sleeves 19, 29 may be affixed to the shelf 18 or 28 using various techniques. For example, the sleeve 19, 29 may be a separate piece that is preferably joined to the shelf 12 or 28 using well-known means, such as adhesives, fasteners, welding, brazing, or soldering. Alternatively, the sleeve 19, 29 may be affixed to the shelf 12 or 28 by being made integral therewith, such as by molding or casting.

The cabinet 10 incorporating this invention may have only one shelf 18, 28 having one or more sleeves 19, 29 affixed to its underside, or it may have more than one shelf 18, 28 each having one or more sleeves 19, 29 affixed to its underside. One or more sleeves 19, 29 may be affixed to an underside of the top panel 16. In addition, the cabinet 10 may have one or more shelves 12 with no sleeves affixed. The cabinet 10 may have additional features, such as doors or dividers, without departing from the scope of this invention.

From the above disclosure of the general principles of the present invention and the preceding detailed description of a preferred embodiment, those skilled in the art will readily comprehend that the invention is susceptible to various modifications. Therefore, the invention is limited only by the scope of the following claims and equivalents thereof.

What is claimed is:

1. A cabinet comprising:

a housing having two generally planar side panels, a generally planar top panel secured to an upper extremity of each said side panel, and a generally planar bottom panel secured to a lower extremity of each said side panel;

at least one generally planar shelf supported in said housing, an upper surface of each said shelf being adapted to support items thereon;

at least one sleeve affixed to an underside of said at least one shelf such that an outer surface of said sleeve is affixed to said underside of said shelf, said sleeve being adapted for selected items to be inserted therein;

a connector affixing said at least one sleeve to said underside of said shelf; and a shelf extension telescopingly mounted to said shelf to accommodate various sizes of the cabinet.

2. The cabinet of claim 1 wherein a plurality of sleeves each having a circular cross-section are affixed to said underside of said at least one shelf.

3. The cabinet of claim 2 wherein said circular sleeves have variously sized diameters to accommodate variously sized selected items therein.

4. The cabinet of claim 1 wherein a plurality of sleeves each having a quadrangular cross-section are affixed to said underside of said at least one shelf.

5. The cabinet of claim 4 wherein said quadrangular sleeves have variously sized cross-sections to accommodate variously sized selected items therein.

6. A medicine cabinet comprising:

a metal housing having two generally planar side panels, a generally planar top panel secured to an upper extremity of each said side panel, and a generally planar bottom panel secured to a lower extremity of each said side panel;

a plurality of generally planar shelves supported in said housing, an upper surface of each said shelf being adapted to support items thereon;

a plurality of sleeves affixed to an underside of selected ones of said shelves such that an outer surface of said sleeve is affixed to said underside of said shelf, said sleeve being adapted for selected items to be inserted therein, each said sleeve having either a circular or a quadrangular cross-section and said sleeves having variously sized cross-sections to accommodate variously sized items therein;

a connector for each said sleeve to affix said sleeve to said underside of said selected ones of said shelves; and a shelf extension telescopingly mounted to selected ones of said shelves to accommodate various sizes of said housing.

* * * * *